United States Patent [19]

Badin et al.

[11] Patent Number: 4,640,055

[45] Date of Patent: Feb. 3, 1987

[54] GRINDING MACHINE FOR GUIDED OR NON-GUIDED BEVELING OR GROOVING OF AN OPHTHALMIC LENS

[75] Inventors: Suzan Badin, Paris; Jean-Francois Moulin, Ris-Orangis; Luc Delattre, Pont Ste-Maxence; Patrice Renan, Paris, all of France

[73] Assignee: Essilor International Cie Generale d'Optique, Cretel, France

[21] Appl. No.: 773,056

[22] Filed: Sep. 6, 1985

[30] Foreign Application Priority Data

Sep. 11, 1984 [FR] France ..... 84 13906

[51] Int. Cl.[4] ..... B24B 9/08

[52] U.S. Cl. ..... 51/101 LG; 51/105 LG; 51/106 LG

[58] Field of Search ... 51/101 LG, 105 LG, 106 LG, 51/105 R, 165.78

[56] References Cited

U.S. PATENT DOCUMENTS

| | | | |
|---|---|---|---|
| 2,814,917 | 12/1957 | Mentzer et al. | 51/105 R |
| 3,332,172 | 7/1967 | Stern | 51/101 |
| 4,176,498 | 12/1979 | Vulich et al. | 51/101 |
| 4,191,501 | 3/1980 | Sinklier et al. | 409/104 |

FOREIGN PATENT DOCUMENTS

| | | |
|---|---|---|
| 2124843 | 9/1972 | France . |
| 2553323 | 4/1985 | France . |
| 1327732 | 8/1973 | United Kingdom . |
| 2148159 | 5/1985 | United Kingdom . |

*Primary Examiner*—Robert P. Olszewski
*Assistant Examiner*—Maurina Rachuba
*Attorney, Agent, or Firm*—Charles E. Brown; Charles A. Brown

[57] ABSTRACT

In a grinding machine for beveling or grooving an ophthalmic lens in guided or non-guided modes, the support shaft for the grinding tool is mounted to be movable relative to that carrying the ophthalmic lens to be processed. Associated with it are displacement means adapted to procure its guided displacement parallel to its axis. Between this mobile support shaft and the associated displacement means are selectively engageable coupling means. These procure either axial displacement of the mobile support shaft by virtue of the drive action of said displacement means or disengagement relative to said displacement means at least.

8 Claims, 7 Drawing Figures

GRINDING MACHINE FOR GUIDED OR NON-GUIDED BEVELING OR GROOVING OF AN OPHTHALMIC LENS

BACKGROUND OF THE INVENTION

1. Field of the invention

The present invention is generally concerned with beveling or grooving an ophthalmic lens.

2. Description of the prior art

As is known, when the ring or surround of the eyeglass frame in which an ophthalmic lens is to be mounted comprises an annular groove, commonly called a bezel, for retaining the lens, it is necessary to form on the peripheral edge surface of the ophthalmic lens, after trimming the latter to the contour of said ring or surround, a rib or bevel, generally of triangular transverse cross-section, adapted for its engagement in said groove in the latter.

Likewise, it is necessary to form a groove in it when the ring or surround of the eyeglass frame concerned comprises a tang and/or filament for retaining the lens.

In the following description and for reasons of convenience only, reference will more often than not be made only to the beveling needed to form a rib or bevel, but it is to be understood that the operations concerned could equally well relate to the grooving necessary to form a groove.

In practice, this beveling and the trimming which preceeds it are carried out on a machine, usually called a grinding machine, comprising at a machining station and on a frame a first support shaft which carries at least one beveling or grooving grinding tool and which is mounted so as to rotate when driven by a drive motor, and a second support shaft disposed parallel to the first and likewise rotatable, adapted to grip axially an ophthalmic lens in line with said beveling or grooving griding tool so that the edge of said ophthalmic lens is in contact with the latter.

It is, of course, important that the bevel formed on an ophthalmic lens processed by means of a grinding machine of this kind is actually on the edge surface thereof, between its circumferential edges.

In practice, in order to take account of the inherent curvature of an ophthalmic lens of this kind, and possible variation in its thickness, in particular when it is a so-called progressive lens the focal length of which varies continually, and of the "meniscus" which the ring or surround in which the lens is to be mounted itself features, in other words the inherent curvature of this ring or surround, it is necessary to displace the lens parallel to its axis during its rotation relative to the beveling grinding tool, so that its point of contact with the latter follows an appropriate trajectory between its circumferential edges.

In other words, it is necessary to provide for relative axial displacement between the two support shafts concerned, that carrying the ophthalmic lens and that carrying the beveling grinding tool.

The relative axial displacement which thus has to be applied to one of these support shafts, hereinafter referred to for convenience as the mobile support shaft, may be provided manually.

This presupposes a certain degree of dexterity on the part of the operator, the corresponding beveling of the ophthalmic lens being done merely by eye.

Consequently, the result is always to some extent approximate.

Alternatively, relative axial displacement of the mobile support shaft may be freely effected by the utilization of a beveling grinding tool with two slant edges into the groove in which the entire edge of the lens is inserted so that it is automatically and continuously centered.

Although this arrangement is advantageously very simple to implement, in practice it is suitable only for relatively thin and uniformly curved ophthalmic lenses.

When it is a matter of processing a thick edged ophthalmic lens, especially a toriodal ophthalmic lens, the necessary width of a beveling grinding tool with two slant edges rapidly becomes unacceptable.

As a corollary to this, when it is a matter of processing a progressive ophthalmic lens, for example, and thus one which has a thickness varying along its circumference, the bevel to be formed may "overstep" the bounds of this circumference in the thinnest part of the lens concerned or, in other words, go wrong in this area.

It is for this reason that it has been proposed, in constructing grinding machines for processing this type of lens in particular, to control or in other words guide the relative axial displacement of the two support shafts, by means of an appropriate control system, so that the point of contact of the ophthalmic lens with the beveling grinding tool follows a predetermined trajectory.

Various methods of control may be envisaged.

The grinding machine described in French patent application No. 83 16574 filed Oct. 18, 1983, for which the present invention is particularly but not necessarily exclusively intended, used one of these methods.

Be this as it may, it is obvious that for a relatively thin ophthalmic lens of uniform curvature such controled guided beveling is unnecessary.

In practice, the practitioner would find it beneficial to have a grinding machine providing for either guided beveling or non-guided beveling.

To provide a grinding machine of this kind is one object of the present invention.

SUMMARY OF THE INVENTION

The present invention consists in a machine for beveling or grooving an ophthalmic lens comprising, at a machining station, a frame, a first rotatable support shaft, at least one beveling or grooving grinding tool on said first support shaft, a motor driving said first support shaft, a second rotatable support shaft parallel to said first support shaft adapted to grip axially an ophthalmic lens in line with said beveling or grooving grinding tool so that an edge of said ophthalmic lens is in contact therewith, one at least of said support shafts, hereinafter referred to as the mobile support shaft, being adapted to be movable on said frame parallel to its axis, means for procuring guided displacement of said mobile support shaft parallel to said axis, and selectively engageable coupling means between said mobile support shaft and said displacement means whereby said mobile support shaft may be moved axially by said displacement means or disengaged relative to said displacement means at least.

In practice, a preferred embodiment further comprises a support member of said mobile support shaft and said displacement means comprise a drive member and said coupling means comprise two spaced flanges disposed transversely relative to the axis of said mobile support shaft and fastened to one of said support and drive members and abutment means between said flanges carried by the other of said drive and support members mobile relative to said other of said drive and support members between a retracted, disengaged position in which they are spaced from said flanges and a deployed, engaged position in which they are braced between them.

To effectively couple the mobile support shaft to the associated displacement means, all that is needed is to move the abutment means to the deployed position; all that is needed to release the mobile support shaft is to move them to the retracted position.

In either case this is advantageously a simple and fast operation.

It is preferably achieved by means of a direct current motor.

In this way it is advantageously possible, if it is necessary to resume the grinding of an ophthalmic lens, to locate the same indexing point on the lens and so to avoid any damage to the bevel already formed on its edge.

The characteristics and advanges of the invention will emerge from the following description given by way of example with reference to the accompanying schematic drawings.

DESCRIPTION OF THE PREFERRED EMBODIMENT

Figure 2:
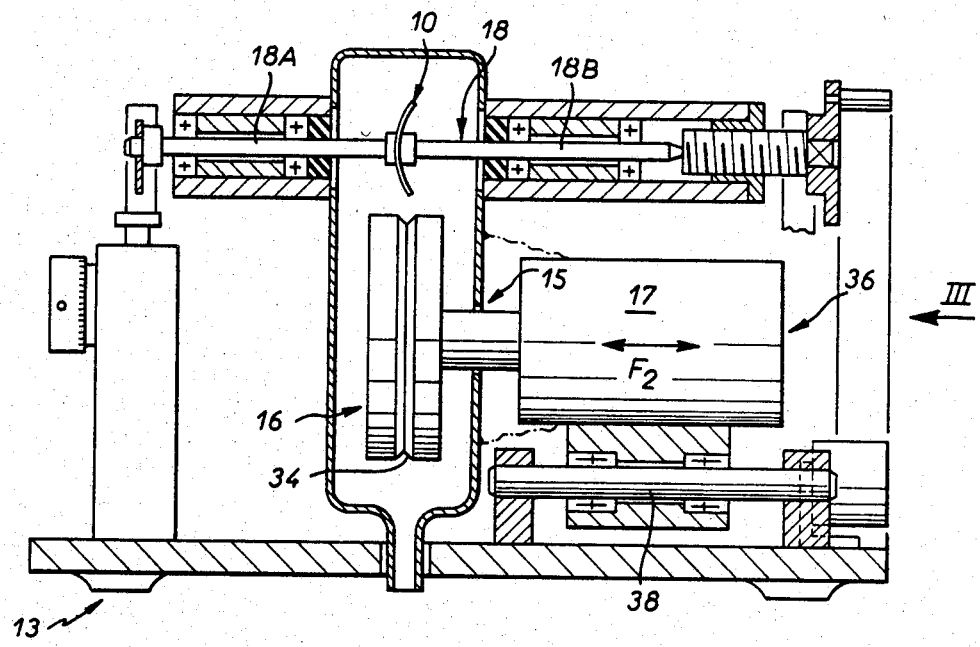
FIG. 2 is a view of it in axial cross-section on the broken line II—II in FIG. 1.

The figures show a grinding machine of the type described in the aforementioned French patent application No. 83 16574.

This grinding machine will not be described in complete detail here.

Only those of its constituent parts necessary for understanding this invention will be described more completely here.

In the embodiment shown, the overall objective is to form on the peripheral edge of an ophthalmic lens 10 a rib or bevel adapted for its engagement in the groove or bezel of the ring or surround of the eyeglass frame in which it must be mounted.

The grinding machine employed for such beveling generally comprises, at a corresponding machining station, on a frame 13, a first support shaft 15 which carries at least one beveling grinding tool 16 and which is mounted to rotate when driven by a drive motor 17, and a second support shaft 18 parallel to the first and likewise mounted to rotate, adapted to grip axially the ophthalmic lens 10 in line with the beveling grinding tool 16 so that its edge contacts the latter.

In the manner which is known per se, this second support shaft 18 is formed in practice by two half-shafts 18A and 18B adapted to grip between them the ophthalmic lens 10 that they are to carry, one of these half-shafts 18A, 18B being to this end movable axially relative to the other and lockable axially in position relative thereto.

For beveling the ophthalmic lens 10, the beveling grinding tool 16 comprises, in its central area, a groove 34 which is V-shaped in transverse cross-section.

The tool 16 is disposed at the end of the support shaft 15 which carries it.

To enable the ophthalmic lens 10 to be processed to move axially relative to the beveling grinding tool 16, one at least of the support shafts 15, 18, hereinafter referred to for convenience as the mobile support shaft, is mounted so as to be movable on the frame 13 parallel to its axis, in association with displacement means adapted to procure guided displacement of it parallel to said axis.

In the embodiment shown, as in the aforementioned French patent application No. 83 16574, it is the support shaft 15 carrying the beveling grinding tool 16 which is the mobile one.

Figure 1:
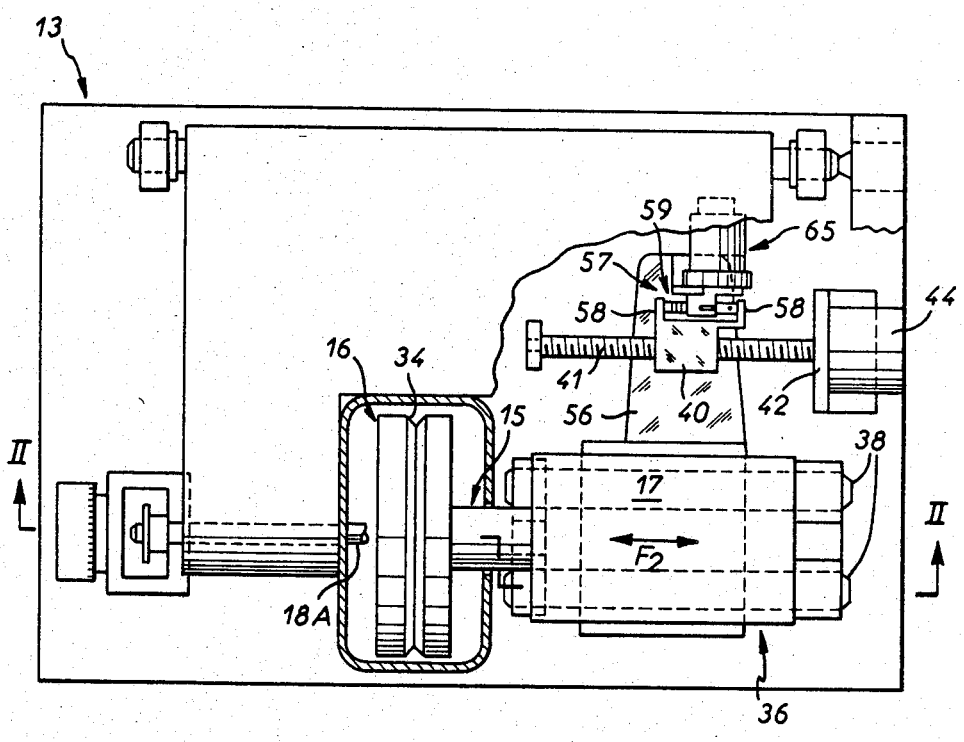
FIG. 1 is a plan view in partial cross-section of a grinding machine in accordance with the invention.
Figure 3:
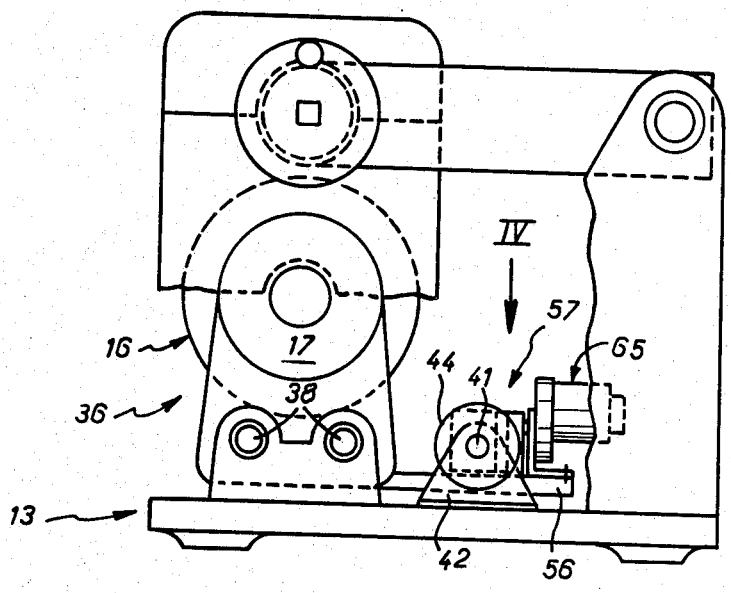
FIG. 3 is partially cut away side view of it in the direction of the arrow III in FIG. 2.
Figure 4:
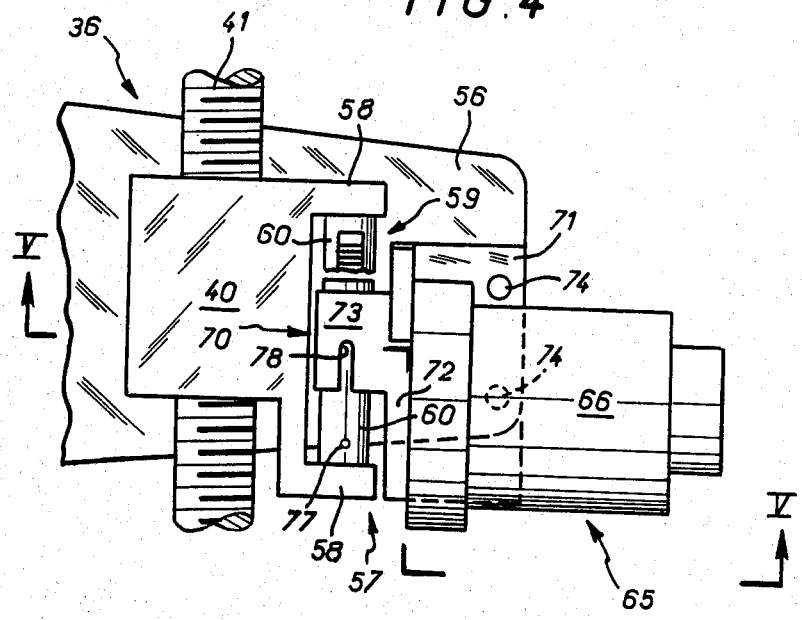
FIG. 4 is a partial plan view to a larger scale of the grinding machine in accordance with the invention in the direction of the arrow IV in FIG. 3.

To this end the support shaft 15, beveling grinding tool 16 and drive motor 17 are carried by a member 36 hereinafter referred to for convenience as the support member mounted to move on the frame 13 parallel to the axis of the support shaft 15 in the direction of the double-headed arrow F2 in FIGS. 1 and 2.

In the embodiment shown, this support member or carriage 36 is, to this end, engaged with two parallel guides 38 carried by the frame 13.

For reasons which will emerge hereinafter, it comprises on one side a baseplate 56 which extends cantilever-fashion parallel to and spaced from the frame 13.

The displacement means associated with the mobile support shaft 15 conjointly comprise a member 40, referred to hereinafter for convenience as the drive member, in practice a simple threaded bush, and a threaded rod 41 which, rotatably mounted on the frame 13, is keyed to the output shaft of a stepper motor 44 so as to rotate therewith.

In accordance with the invention, between the mobile support shaft 15 and the displacement means associated therewith there are provided selectively engageable coupling means 57 adapted to command axial displacement of said mobile support shaft 15 by said displacement means or its disengagement at least relative to these means.

In practice these selectively engageable coupling means 57 comprise two flanges 58 spaced from one another, transversely disposed relative to the axis of the mobile support shaft 15 and fastened to one or other of the aforementioned members 36, 40 and, between said flanges 58, abutment means 59 carried by the other of said members 36, 40 and mounted on the latter so as to be movable between a retracted, disengaged position in which they are spaced from the flanges 58 and a deployed, engaged position in which they are braced between the latter.

In the embodiment shown, the flanges 58 are fastened to the drive member 40, whereas the associated abutment means 59 are carried by the support member 36, more precisely by the baseplate 56 which the latter comprises, this baseplate extending to this end beyond the threaded rod 41 of the associated displacement means, between this threaded rod 41 and the frame 13.

In the embodiment shown, the abutment means 59 comprise two strip members 60 movable in opposite directions parallel to the axis of the mobile support shaft 15 and each adapted in the deployed position (FIG. 6) to bear at one transverse end against one of the flanges 58.

In practice, these two strip members 60 are arranged to move synchronously on the support member 36 which carries them and each is on this end fastened to a respective one of two racks 62 disposed one on each side of a common drive pinion 63 rotatably mounted on said support member 36 and meshing with both the racks.

The drive pinion 63 is keyed to the output shaft 64 of a motor-gearbox unit 65 which is also carried by the support member 36 and the motor 66 of which is preferably a direct current motor.

The motor 66 is controlable by the user.

Figure 5:
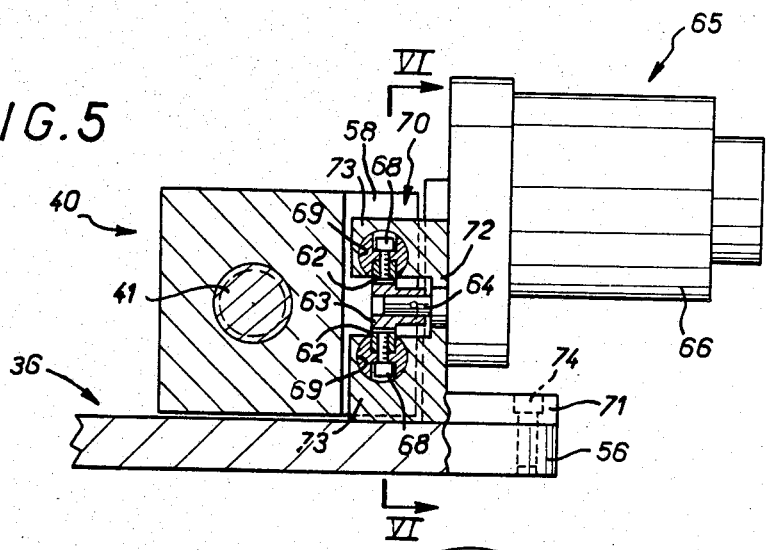
FIG. 5 is a view of it in partial cross-section on the broken line V—V in FIG. 4, to the same scale as FIG. 4.

In practice the racks 62 are attached to the strip members 60 by screws 68 (FIG. 5) and these strip members 60 slide in respective guides 69 forming part of the support member 36 which carries them, more precisely of a yoke-shaped part 70 itself attached by a baseplate 71 and by means of screws 74 to the baseplate 56 that said support member 36 comprises.

It is this yoke-shaped part 70 which carries the motor-gearbox unit 65 on the back of its median part 72 and the drive pinion 63 which is rotatably mounted on said median part 72, extending between its branches 73, each of which comprises the guide 69 associated with the corresponding strip member 60.

For preference, and as shown here, with regard to each strip member 60, that of the flanges 58 opposite the flange with which it cooperates in bearing engagement in the deployed position features, in line with it, that is to say by way of an extension thereof, a passage 75 adapted to receive it.

Finally, one of the strip members 60, in practice that farthest from the frame 13, carries an upwardly projecting pin 77 designed for abutmentwise cooperation with the bottom of a groove 78 formed for this purpose in the corresponding branch 73 of the yoke-shaped member 70 in which the strip members 60 are slidably mounted.

Figure 6:
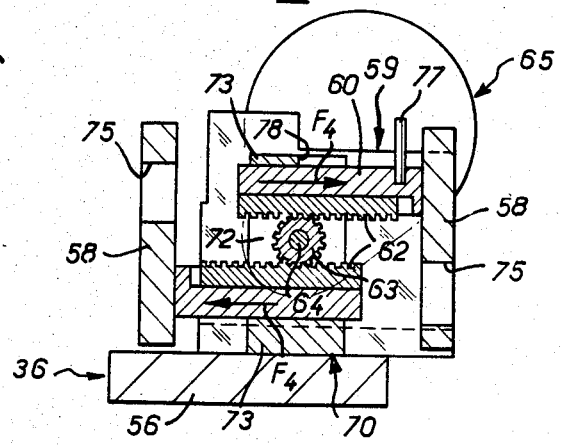
FIG. 6 is a view of it in partial cross-section on the line VI—VI in FIG. 5, to the same scale, with the abutment means employed in it shown in the deployed position.

For a first direction of power supply to the direct current motor 66, the strip members 60 come into abutting engagement against their respective flanges 58, moving conjointly and synchronously but in opposite directions relative to one another, as shown by the arrows F4 in FIG. 6.

For the deployed, engagement position which these strip members 60 then occupy, the abutment means 59 which they conjointly form are braced between the flanges 58 and as a result of this the support member 36 which carries them is ocupled to the flanges 58 so as to move therewith.

Thus in this case the motor 44 controls relative axial displacement of the mobile support shaft 15 relative to the support shaft 18, this representing a so-called guided beveling mode in respect of the ophthalmic lens 10 being processed.

Figure 7:
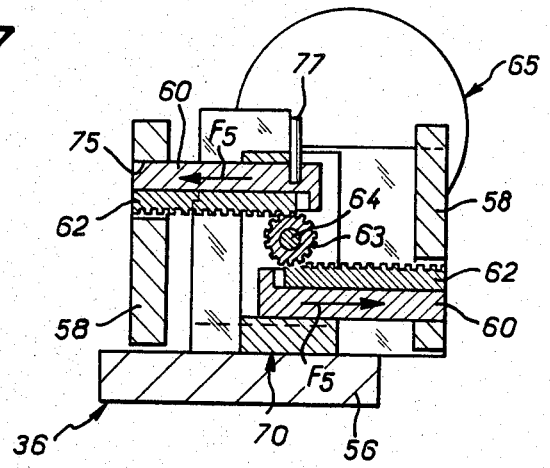
FIG. 7 is a view of it in partial cross-section analogous to that of FIG. 6, with these abutment means shown in the retracted position.

On the other hand, for the opposite direction of power supply to the direct current motor 66, the strip members 60 move away from their respective flanges 58, as shown by the arrows F5 in FIG. 7.

This movement, which is in practice facilitated by their insertion into the corresponding passage 75 in the opposite flange 58 and which is in practice also limited by the abutment engagement of the pin 77 against the bottom of the corresponding notch 78 of the yoke-shaped part 70 which carries them, displaces them to a retracted, disengaged position (FIG. 7) in which each is spaced from its respective bearing flange 58.

As a result of this, at least within limits set by their coming into abutting engagement against the yoke-shaped part 70, the flanges 58 and therefore the drive member 40 which carries them are free to move parallel to the axis of the mobile support shaft 15 without any interaction with the displacement means normally associated with the latter, this representing a so-called non-guided beveling mode with regard to the ophthalmic lens 10 being processed.

Thus it is advantageously possible in accordance with the invention to employ guided or non-guided beveling according to the characteristics of the ophthalmic lens 10 to be processed.

To do this it is only necessary to operate appropriately on the direct current motor 66.

It is to be understood that the present invention is not limited to the embodiment described and shown, but encompasses any variant execution.

Also, its field of application is not limited to that of the grinding machine described in French patent application No. 83 16574, but on the contrary encompasses any grinding machine in which one of the support shafts for the ophthalmic lens or for the beveling grinding tool is mounted movably relative to the other.

Finally, and as already indicated previously, its field of application is not limited to that of beveling ophthalmic lenses, but also encompasses the grooving thereof.

We claim:

1. Machine for beveling or grooving an ophthalmic lens, said machine comprising, at a machining station, a frame, a first support shaft, means mounting said first support shaft on said frame for rotation, at least one beveling or grooving grinding tool on said first support shaft, a motor forming means for driving said first support shaft, a rotatable second support shaft, means mounting said second support shaft on said frame parallel to said first support shaft and for rotation, said second support shaft having means for axially gripping an ophthalmic lens for edgewise contact of such lens with said beveling or grooving grinding tool, at least one of said support shafts being a mobile support shaft, and carried on a support member for movement relative to said frame and parallel to the axis of said mobile support shaft, displacement means for procuring guided displacement of said mobile support shaft parallel to its axis comprising a drive member, selectively engageable coupling means arranged between said mobile support shaft and said displacement means, said coupling means comprising two spaced flanges disposed transversely relative to the axis of said mobile support shaft and fastened to a selected one of said support and drive members, and abutment means disposed between said flanges carried by the other of said drive and support members, said abutment means being movable generally perpendicularly to said flanges between a disengaged position in which said abutment means are out of engagement with said flanges for uncoupling said mobile support shaft from said displacement means and an engaged position in which said abutment means are braced between said flanges for coupling said mobile support shaft with said displacement means.

2. Machine according to claim 1, wherein said abutment means comprise two strip members movable relative to each other in opposite directions parallel to the axis of said mobile support shaft and in braced abutment against said flanges in said engaged position.

3. Machine according to claim 2, wherein said strip members are carried by said support member and are movable synchronously thereon.

4. Machine according to claim 3, further comprising a toothed rack fastened to each of said strip members and a drive pinion rotatably mounted on said support member and meshing with said racks.

5. Machine according to claim 4, further comprising a direct current motor having an output shaft to which said drive pinion is fixed for rotation.

6. Machine according to claim 2, wherein said support member comprises two guides, one of said strip members being slidable in each of said guides.

7. Machine according to claim 2, wherein each of said flanges has an opening in line with a respective one of said strip members adapted to cooperate in bearing engagement in said engaged position with the other of said flanges, said strip members being received in said openings of said flanges in said disengaged position.

8. Machine according to claim 1, wherein said flanges are fastened to said drive member and said abutment means are carried by said support member.

* * * * *